US007410405B2

(12) United States Patent
Hornsby et al.

(10) Patent No.: US 7,410,405 B2
(45) Date of Patent: Aug. 12, 2008

(54) AMUSEMENT DEVICE AND METHOD

(75) Inventors: James R. Hornsby, St. Louis, MO (US); Marcellus R. Benson, St. Louis, MO (US); Paul M. Brown, St. Louis, MO (US); Joseph L. McGowan, St. Charles, MO (US)

(73) Assignee: Jakks Pacific, Inc., Malibu, CA (US)

( * ) Notice: Subject to any disclaimer, the term of this patent is extended or adjusted under 35 U.S.C. 154(b) by 0 days.

(21) Appl. No.: 10/066,818

(22) Filed: Feb. 4, 2002

(65) Prior Publication Data

US 2002/0127946 A1 Sep. 12, 2002

Related U.S. Application Data

(60) Provisional application No. 60/266,336, filed on Feb. 2, 2001.

(51) Int. Cl.
*A63H 33/26* (2006.01)

(52) U.S. Cl. ..... 446/485; 446/176; 222/79

(58) Field of Classification Search ..... 446/483, 446/176, 180, 211, 485, 15; 222/79, 113; 463/49–57; 239/444, 99, 16, 17, 18; 362/251, 362/112, 113, 114; 200/16 R–16 D, 522, 200/332.2, 547, 549, 550

See application file for complete search history.

(56) References Cited

U.S. PATENT DOCUMENTS 4,239,129 A 12/1980 Esposito
4,750,641 A * 6/1988 Chin-Fu ..... 222/79
5,321,591 A * 6/1994 Cimock et al. ..... 446/485
5,322,191 A * 6/1994 Johnson et al. ..... 222/79
5,549,220 A * 8/1996 Whalen ..... 222/1
5,779,100 A * 7/1998 Johnson ..... 222/79
5,818,148 A * 10/1998 Shiomi ..... 310/328
5,984,788 A * 11/1999 Lebensfeld et al. ..... 463/51
6,050,498 A * 4/2000 Minoura et al. ..... 239/112
6,196,471 B1 * 3/2001 Ruthenberg ..... 239/18
6,203,397 B1 * 3/2001 Applewhite et al. ..... 446/475
6,280,277 B1 * 8/2001 Greenberg et al. ..... 222/79
6,302,796 B1 * 10/2001 Lebensfeld et al. ..... 463/51
6,416,377 B1 * 7/2002 Bart ..... 446/15
6,469,268 B1 * 10/2002 Schaeffeler et al. ..... 200/522
6,474,507 B1 * 11/2002 Hornsby et al. ..... 222/79

* cited by examiner

*Primary Examiner*—Eugene Kim
*Assistant Examiner*—Urszula M Cegielnik
(74) *Attorney, Agent, or Firm*—Richard B. Klar; Law Office of Richard B. Klar

(57) ABSTRACT

The subject invention provides an amusement device and method of play using the device, wherein the device includes a gun for shooting a liquid and/or a light beam, wherein the gun comprises a generally elongated barrel, a tank for containing a liquid, a source of power, a pump for pressurizing the tank, valve structures suitable for controlling the flow of the liquid, at least one light source, and a trigger mechanism which may selectively cause a stream of liquid to be discharged and one of more of the light sources to be activated.

34 Claims, 6 Drawing Sheets

AMUSEMENT DEVICE AND METHOD

The present application claims the priority of a U.S. provisional patent application, Ser. No. 60/266,336, filed Feb. 2, 2001, which is incorporated herein by reference.

BACKGROUND OF THE INVENTION

1. Field of the Invention

The present invention relates to a water amusement device. More particularly, the present invention relates to a squirt gun device wherein activation of the squirt gun also activates the emission of light, and a method of play using the device.

2. Description of the Prior Art

Squirt gun devices have been known for a long time. A typical squirt gun device will generally include a gun shaped housing having a barrel shaped portion and a handle portion depending therefrom, a fluid tank, a pumping mechanism in communication with the tank, and a water passage which extends from the tank to an opening located in front of the barrel.

In operation, discharge of fluid from a typical squirt gun is driven by a trigger which is coupled to the pumping device. Squeezing the trigger drives the pumping device to pressurize the tank. The pressure forces fluid to flow from the tank, through the water passage and out of the opening. There are also known squirt gun devices wherein the trigger activates motor coupled to the pumping mechanism.

Typically, squirt guns are relegated to outdoor use where the flowing streams of water do not generally cause any serious property damage or present any potential hazard. However, and obviously, flowing streams of fluid discharged from these squirt guns can damage property. Indoor use may damage walls, floors, and fabrics and can also create serious potential hazards, such as shorting out electrical appliances and outlets, or creating slippery surfaces. As such, squirt guns are typically not used indoors.

Consequently, there would be a benefit in a squirt gun device which has an alternative entertaining use when utilized indoors. Furthermore, to some there may also be an aesthetical benefit in illuminating the squirt gun device during use. What is needed is a squirt gun that uses light sources to provide an alternative entertaining use in conjunction with or aside from the normal discharge of fluid.

SUMMARY OF THE INVENTION

The present invention provides an amusement device which can be used for both indoor and outdoor play. In one embodiment, the present invention is an amusement device configured as a squirt gun, wherein the squirt gun produces a lighted coherent "shot" or stream of liquid when the trigger is pulled.

The subject invention provides an amusement device and method of play using the device, wherein the device includes a gun for shooting a liquid and/or a light beam, wherein the gun comprises a generally elongated barrel, a tank for containing a liquid, a source of power, a pump for pressurizing the tank, valve structures suitable for controlling the flow of the liquid, at least one light source, and a trigger mechanism which may selectively cause a stream of liquid to be discharged and one or more of the light sources to be activated.

In one embodiment, the subject invention provides a squirt gun for shooting a stream or burst of liquid, wherein the gun comprises a generally elongated barrel enclosing therein a tank for containing a liquid, a source of power, a pump for pressurizing the tank and valve structures suitable for controlling the flow of liquid. The subject invention may also include at least one light source adjacent to the front end for illuminating a stream of liquid, a plurality of light sources for illuminating the barrel, and a trigger mechanism which causes a stream of liquid to be expelled and concurrently illuminates the subject squirt gun.

In any embodiment of the present invention, the trigger and/or trigger valve water releasing structure may comprise a trigger-valve arrangement as shown in U.S. Pat. No. 4,239,129, which patent is incorporated herein by reference.

In operation, the subject squirt gun is capable of being used with or without water. This enables the subject squirt gun to be used indoors without the drawbacks normally associated with indoor use of a squirt gun. In one embodiment, the subject squirt gun also includes an infra-red (IR) emitter and an IR receiver enabling a user to play an optical tag game. The trigger mechanism activates the IR emitter causing it to transmit an IR beam. When hit by an IR beam of sufficient strength, the IR receiver disables the squirt gun for a period of time. In one embodiment of a game or method of play using the gun of the present invention, the users may play a game of optical tag, wherein the participant would try to shoot each other's guns in order to disable them.

While several embodiments are disclosed, still other embodiments of the present invention will become apparent to those skilled in the art from the following detailed description. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

The subject invention is a water amusement device which combines the ability to discharge fluid with illumination. For the purposes of illustration only, the subject invention is configured to resemble a squirt gun. A person skilled in the art can appreciate that the subject invention can be easily adapted to form an alternative device such as a figurine.

In the following description, any directional references such as right and left, top and bottom, front and rear, upper and lower, and horizontal and vertical are to be read and understood with their conventional meanings and with reference to viewing the embodiments depicted in the Figures.

With regard to means for fastening, mounting, attaching or connecting the components of the present invention to form the subject water amusement device, unless specifically described otherwise, such means are intended to encompass conventional fasteners such as screws, rivets, stitching, nuts and bolts, toggles, pins, and the like. Other fastening or attachment means appropriate for connecting or mounting components of the present invention include adhesives and soldering, the latter particularly with regard to electrical connections required for electrical or electromechanical components associated with the device.

Unless specifically otherwise disclosed or taught, materials for making the components of the present invention are selected from appropriate materials such as aluminum, wood, steel, fabric, metallic alloys, various plastics and vinyls, including curable plastics or foams, plexiglass, fiberglass and the like.

Figure 1:
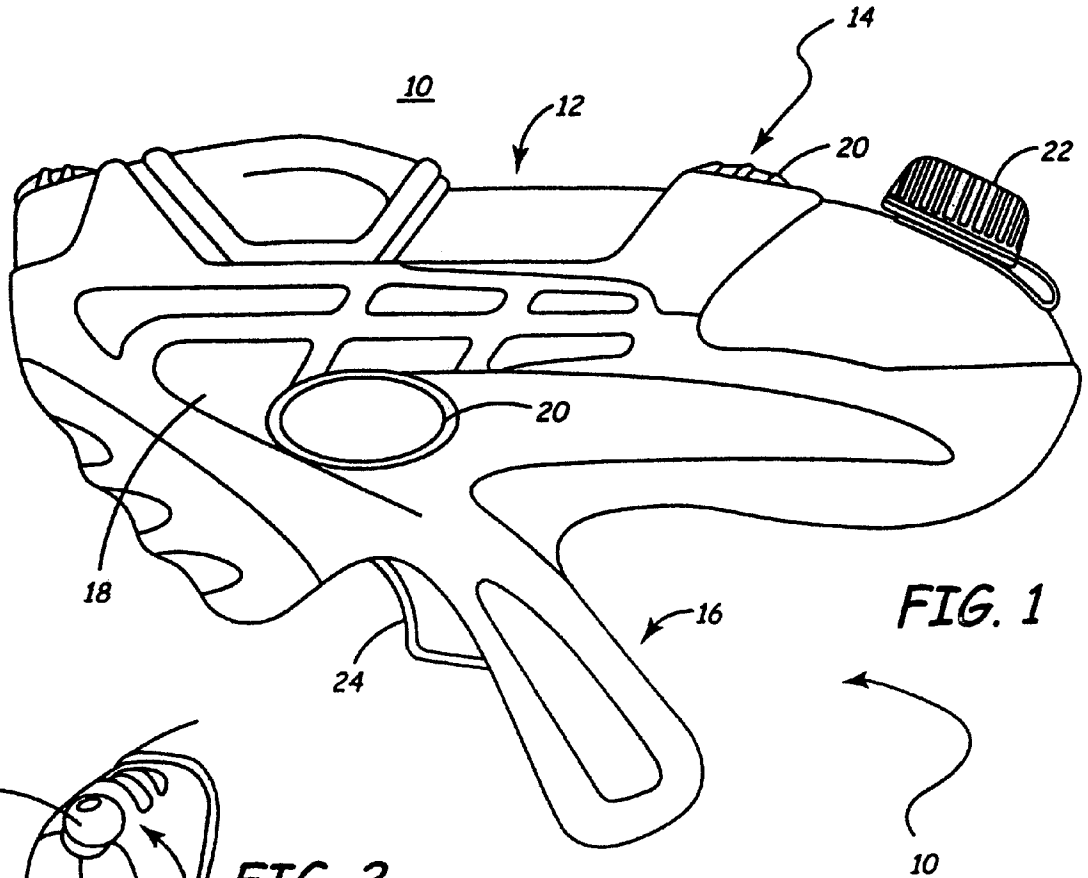
FIG. 1 is a side view of one embodiment of the subject squirt gun device.

FIG. 1 shows one embodiment of the subject water amusement device. As shown, the water amusement device includes a housing 12 that is shaped to generally resemble a gun 10, with a barrel portion 14 and a handle portion 16 depending therefrom. As is evident to one skilled in the art, the housing serves a largely aesthetic function, and can easily be reconfigured into a variety of different shapes and sizes without affecting the novelty of the subject invention.

Figure 2:
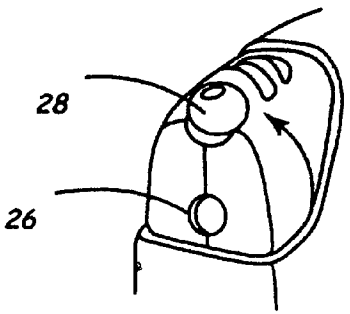
FIG. 2 is an enlarged, sectional view of an IR dome for the squirt gun device of FIG. 1.

The barrel portion 14 of the housing includes openings extending therethrough which are covered by translucent panels 18 or domes 20. A cap 22 seals an opening extending through the rear of the barrel portion 14. A trigger 24 extends laterally from the handle portion 16. As shown in FIG. 2, an infrared red emitter 26 and an infrared receiver 28 are disposed along the front of the barrel portion 14.

Water Pumping Mechanism

Figure 3A:
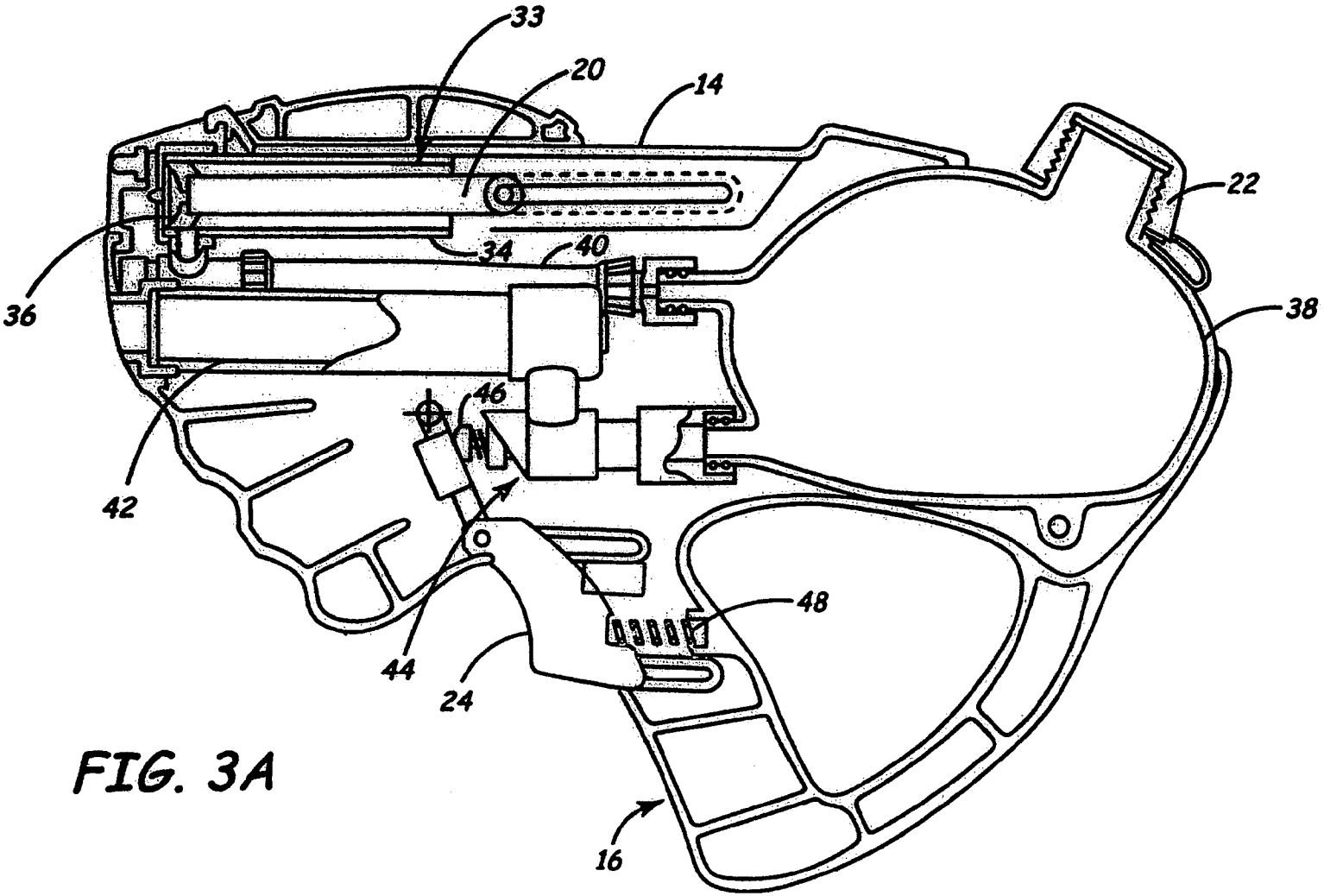
FIG. 3*a* is a partially cut away, of an alternate embodiment of the subject squirt gun device depicting internal operational mechanisms.

As shown in FIG. 3, in one embodiment, the water pumping mechanism includes an air pump 33 comprised of a piston 32 longitudinally disposed within a pressure cylinder 34. The piston 32 includes a sealing member 36 which contacts the sides of the pressure cylinder 34 forming a relatively air tight seal. The piston 32 is reciprocally and longitudinally displaced in the pressure cylinder 34 to generate air pressure.

The air pump 33 communicates with a tank 38 through an air hose 40 connected therebetween. The piston 32 is preferably driven by a powered motor device, but can also be easily configured to operate manually. The tank 38 serves as a reservoir for fluid, and is maintained in a pressurized state by the air pump 33. In one embodiment, the tank 38 also communicates with an external water supply.

The tank 38 communicates with a coherent nozzle 42 through a valve mechanism 44. The valve mechanism 44 includes a plunger 46 which cooperates with the trigger 24 to regulate fluid flow between the tank 38 and the coherent nozzle 42. Squeezing the trigger 24 towards the handle portion 16 causes the plunger 46 to open the valve mechanism 44, allowing pressurized fluid to travel to the coherent nozzle 42 and out the nozzle opening. A spring 48 coupled to the trigger 24 provides a return bias so releasing the trigger causes a displacement of the trigger 24 away from the handle and causes the plunger 46 to close the valve mechanism 44.

It should also be appreciated that one skilled in the art may easily substitute the disclosed valve mechanism with one that is generally known in the art. There is no inherent novelty in the disclosed valve mechanism and its relationship to the trigger which would necessarily prevent its substitution with a suitable valve mechanism that is known in the art.

Figure 3B:
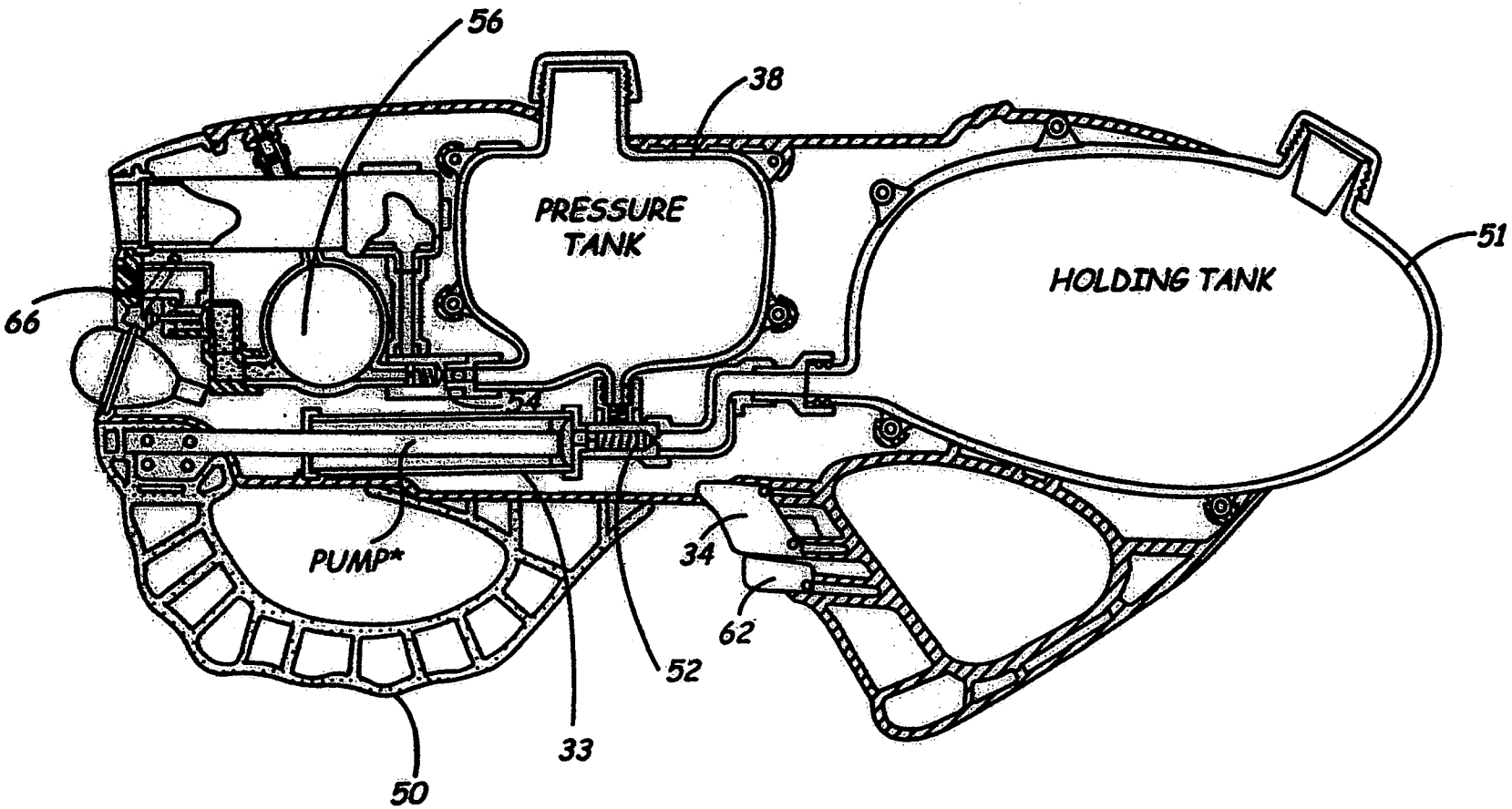
FIG. 3*b* is a partially cut away of another alternate embodiment of the subject squirt gun device depicting the internal operational mechanisms.

As shown in FIG. 3*b*, in one embodiment, the subject invention is configured as a squirt gun having two modes of fluid discharge. In one mode, the discharge is a generally coherent stream, and in another mode it forms a generally conical stream. Each mode of discharge is activated through a separate trigger.

In this embodiment, a pump handle 50 is slidingly coupled to the barrel portion 14, allowing it to slide longitudinally and reciprocally with respect to the barrel portion 14. The pump handle 50 is coupled to a piston 32 of an air pump 33. A one-way valve mechanism 52 controls communication between a holding tank 51 and a first tank 38. Longitudinal movement of the pump handle 50 away from the handle portion 16 creates a negative pressure which induces the one-way valve mechanism 52 to open, allowing water to escape from the holding tank 51. A reciprocal movement of the pump handle generates a positive pressure which closes the one-way valve mechanism 52 and drives fluid into the first tank 38.

A purge valve 54 regulates flow of fluid between the first tank 38 and a second tank 56. In a preferred embodiment, a pressure in excess of 40 psi in the first tank 38 opens the purge valve 54, enabling fluid to transfer from the first tank 38 to the second tank 56.

A first trigger valve mechanism 58 is coupled to a first trigger 60, and a second trigger valve mechanism 62 is coupled to a second trigger 64. Squeezing the first trigger 60 opens the first trigger valve mechanism 58, allowing fluid to flow from the first tank 38 to the coherent nozzle 42, from which the fluid is discharged as a generally coherent stream. Squeezing the second trigger 64 opens the second trigger valve, allowing fluid to flow from the second tank 56 to a conical spray nozzle 66, where the fluid is discharged as a generally conical stream.

Illumination

Figure 4:
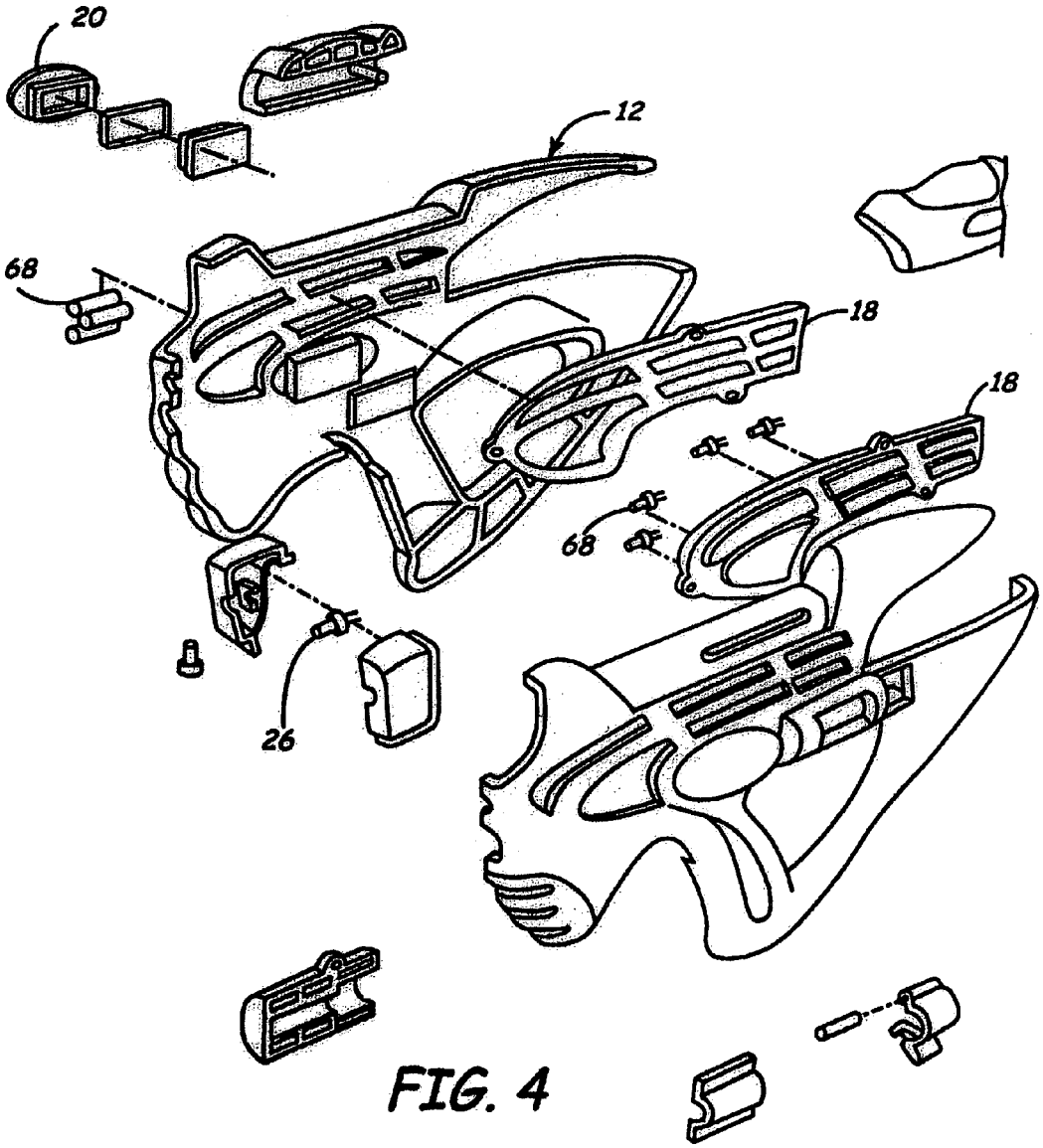
FIG. 4 is an exploded view of the squirt gun of FIG. 3 depicting illumination scheme.

As shown in FIG. 4, in one embodiment, the subject invention includes a plurality of translucent panels 18 disposed across apertures located in the housing 12. The translucent panels 18 are illuminated by a plurality of LED's 68 positioned inside the housing 12, adjacent to the panels. A number of LED's 68 are also positioned adjacent the coherent nozzle 42 to illuminate a stream of fluid being discharged therefrom. A plurality of domes 20 extend through various openings in the housing 12 and are also illuminated by LEDs 68. IR domes 21 are used to protect the IR emitter 26 and the IR receiver 28 located along the front of the barrel portion 14.

Figure 5:
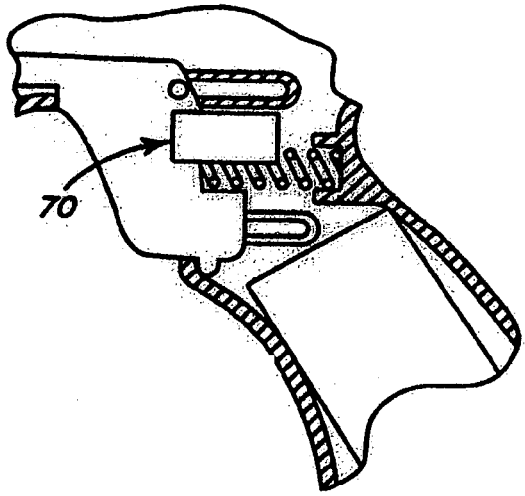
FIG. 5 is an enlarged, sectional view of a trigger mechanism for the squirt gun device of FIG. 3.
Figure 6:
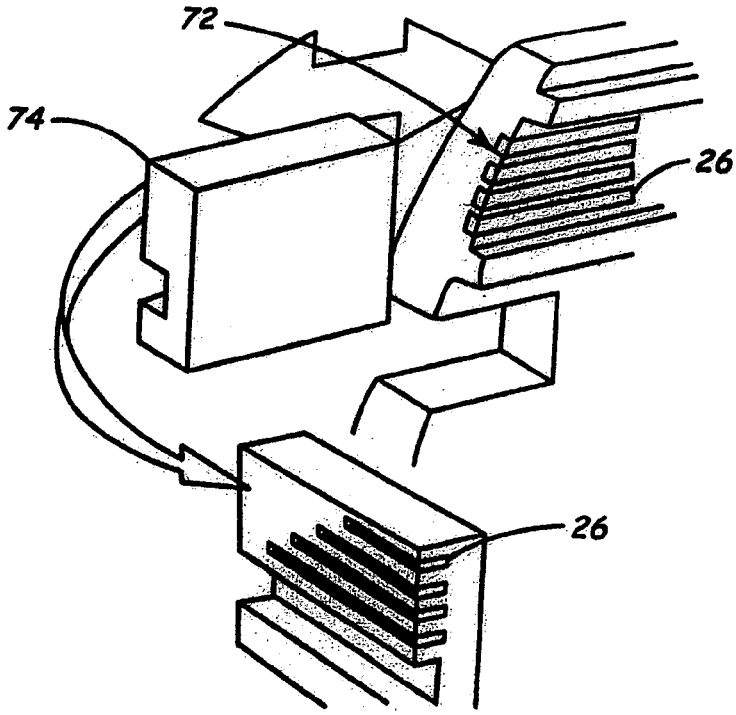
FIG. 6 is an enlarged, sectional view of an illumination switch coupled to the trigger mechanism of FIG. 4.

As shown in FIGS. 5 and 6, the trigger 24 is coupled to a sequence switch 70 which enables the progressive illumination of the LED's 68 and the IR emitter 26. In one embodiment, the sequence switch 70 is comprised of a first switch plate 74 mounted to the housing 12 and a second switch plate 72 coupled to the trigger. The second switch plate 72 is slidably received by the first switch plate 74 such that the second switch plate 72 can travel in overlapping fashion with respect to the first switch plate 74.

In one embodiment, each switch plate includes a plurality of conductive strips 76 of differing lengths with each conductive strip 76 positioned complimentary to a strip on the opposing switch plate. As the trigger 24 is pulled, the second switch plate 72 slides across the first switch plate 74 enabling some of the opposing conductive strips 76 to contact. Contact between conductive strips on different switch plates enable a circuit to close between a suitable power source (e.g. a battery, not shown) and an LED 68 (or LEDs) or an IR emitter 26 or a motor (to power the air pump 33). As the trigger 24 progresses towards the handle portion 16, additional circuits are closed and additional LEDs 68 or IR emitters 26 are activated. Preferably, the conductive strips are arranged so as to allow the LED's to activate sequentially by position, progressing from the rear of the barrel portion 14 to the front, with the IR emitter 26 being activated last.

Operation

The subject invention is first loaded with fluid. Squeezing the trigger will then cause the squirt gun to progressively illuminate from the rear to the front, and generally simultaneous to the illumination, a coherent stream of fluid is discharged from the barrel of the gun. LEDs located adjacent to the coherent nozzle illuminates the stream of fluid. An IR beam is also discharged from the IR emitter 26. Preferably, the IR emitter 26 is limited so that an IR beam is relatively focused in a forward direction with an arc of about 100°.

The subject invention is capable of firing both a stream of water and an IR beam during play, thereby enabling a variety of methods of play. In one method of play, each player tries to shoot at the IR receiver located on the opposing player's gun. When a gun's IR receiver senses an IR beam, the gun is disabled for a period of time (preferably 5-10 seconds). This is achieved by either temporarily disconnecting the power source, or by use of a trigger lock mechanism that is generally known in the art. During that period of time, the disabled gun is not able to discharge liquid or an IR signal, providing the shooter a period of time within which he is able to fire his weapon exclusively to deluge, and/or tag his opponent with another IR signal.

Figure 7:
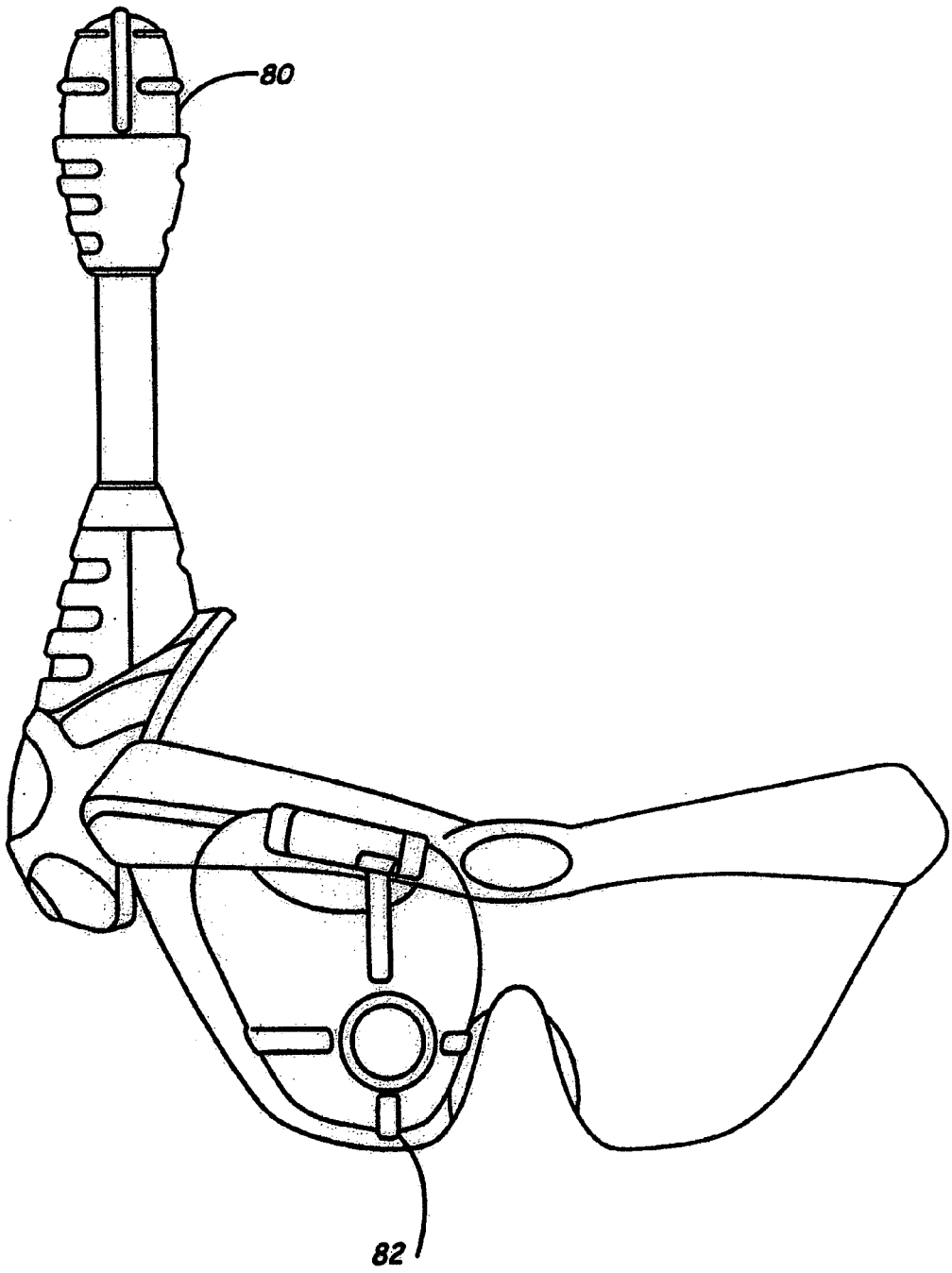
FIG. 7 is a perspective view of a head gear which can be used in combination with the subject invention.

When used indoor, the subject invention can be used exclusively without water. The subject invention may be used in a game of optic tag, trying to disable the opponent's gun as above. Alternatively, opponents may wear an article having an IR receiver therein such as the head gear of FIG. 7. The head gear includes an IR receiver 80 and a visual display 82 which gives a visual indication when hit by an IR beam. When used in the above manner, the subject invention is still capable of being utilized indoors, without the drawbacks associated with indoor water play.

While embodiments of a game using the device are described, users can use the gun(s) of the subject invention to play any game their imaginations can desire. Additionally, embodiments of a gun are disclosed wherein changes may be made and the gun will still be within the scope of the subject invention. For example, a microprocessor controlled light display or trigger mechanism may be used to provide for progressive or sequential illumination. Any suitable IC or processor may be used. The number and location of light sources, including the IR emitter may be changed. More than one IR receiver may be provided on each gun, and the location of the IR receiver may be selectively distributed throughout the gun. A trigger lock mechanism comprising a solenoid coupled to the IR receiver may be incorporated to mechanically prevent the trigger from moving when the IR receiver is hit by an IR beam. The tank may be removably coupled to the gun enabling it to be removed when empty and replaced by a filled tank.

While the present invention has been described with reference to several embodiments thereof, those skilled in the art will recognize various changes that may be made without departing from the spirit and scope of the claimed invention. Accordingly, this invention is not limited to what is shown in the drawings and described in the specification but only as indicated in the appended claims, nor is the claimed invention limited in applicability to one type of computer or computer network. Any numbering or ordering of elements in the following claims is merely for convenience and is not intended to suggest that the ordering of the elements of the claims has any particular significance other than that otherwise expressed by the language of the claim.

What is claimed is:

1. A water amusement apparatus comprising:

a fluid discharge mechanism;

a plurality of light sources; and a sequential trigger mechanism coupled to the fluid discharge mechanism and to the light sources, wherein the sequential trigger mechanism includes confronting first and second switch plates directly slidably coupled to each other, said switch plates each having a longitudinal axis and one of said switch plates being adapted to slidably move in a direction along said longitudinal axis with respect to the longitudinal axis of another of said switch plates, said first and second switch plates each include conductive elements positioned complementary to conductive elements located on said switch plates to touch each other on at least a portion of said conductive elements.

2. The apparatus of claim 1, wherein said light source comprising an IR emitter and each conductive element on the first switch plate is coupled to one of the light sources, each conductive element on the second switch plate is coupled to a power source, and wherein the conductive elements are arranged to activate the light source sequentially.

3. The apparatus of claim 1 and further comprising a gun-disabling mechanism.

4. The apparatus of claim 1, wherein at least one of the light sources is positioned to illuminate fluid discharged from the fluid discharge mechanism.

5. The apparatus of claim 1, wherein the fluid discharge mechanism includes a tank, an air pump in communication with the tank, and a valve mechanism in communication with the tank and in cooperation with the sequential trigger mechanism.

6. The apparatus of claim 1, wherein the fluid discharge mechanism includes a first tank in communication with a second tank through a purge valve, and a pumping mechanism in communication with the first tank.

7. The apparatus of claim 6, and further comprising a first trigger valve coupled to the first tank, and a second trigger valve coupled to the second tank.

8. The apparatus of claim 7 wherein the sequential triggering mechanism is coupled to the first trigger valve, and further comprising a second trigger mechanism coupled to the second trigger valve.

9. A squirt gun comprising:

a fluid discharge mechanism;

an IR transmitter;

an IR receiver;

a trigger mechanism coupled to the fluid discharge mechanism and the IR transmitter; and a trigger lock mechanism coupled to the IR receiver and the trigger mechanism;

wherein said trigger mechanism includes confronting first and second switch plates directly slidably coupled to each other, said switch plates each having a longitudinal axis and one of said switch plates being adapted to slidably move in a direction along said longitudinal axis with respect to the longitudinal axis of another of said switch plates said first and second switch plates each include conductive elements positioned complementary to conductive elements located on said switch plates to touch each other at least a portion of said conductive elements.

10. The gun of claim 9, and further comprising a housing having plurality of light sources disposed therein, the housing enclosing the fluid discharge mechanism.

11. The gun of claim 10, wherein the trigger mechanism includes a mean for sequentially lighting the plurality of light sources.

12. The gun of claim 9, wherein the fluid discharge mechanism includes a means for discharging a generally coherent stream of fluid, and a means for discharging a generally conical stream of fluid.

13. The gun of claim 9, and further comprising a light source for illuminating fluids discharged from the fluid discharge mechanism.

14. The gun of claim 9, and further comprising an external fluid supply in communication with the fluid discharge mechanism.

15. The apparatus of claim 1, and further comprising a gun shaped housing at least partially enclosing the sequential trigger mechanism.

16. A water amusement apparatus comprising:

a fluid discharge mechanism;

a plurality of light sources, located along a fluid discharge mechanism; and a sequential trigger mechanism coupled to the fluid discharge mechanism and to the light sources, wherein the sequential trigger mechanism includes confronting first and second switch plates directly slidably coupled to each other, said first switch plate having a longitudinal axis and said second switch plate having a longitudinal axis and at least one of said switch plates is adapted to slidably move with respect to another of said switch plates along their respective longitudinal axes said first and second switch plates each include conductive elements positioned complementary to conductive elements located on switch plates to touch each other on at least a portion of said conductive elements.

17. The apparatus of claim 1, wherein the trigger of sequential trigger mechanism is pressed to more than one position.

18. The apparatus of claim 1, wherein said plurality of light sources, located along a fluid discharge mechanism.

19. The apparatus of claim 1, wherein the first switching plate is attached to the sequential trigger mechanism and the second switch plate is attached to a housing of the apparatus.

20. The apparatus of claim 2, wherein the conductive elements are arranged to activate the light source sequentially with discharge of fluid by said fluid discharge mechanism.

21. The apparatus of claim 2, wherein the conductive elements are arranged to activate the light source sequentially and independently of discharge of fluid by said fluid discharge mechanism.

22. The apparatus of claim 1, and further comprising a gun-disabling mechanism, wherein the disabling mechanism prevents the sequential trigger mechanism from activating the fluid discharge mechanism.

23. The apparatus of claim 1, wherein at least one of the light sources is positioned along the fluid discharged mechanism and serves to illuminate fluid discharged from the fluid discharge mechanism.

24. The apparatus of claim 1, wherein pressing the sequential trigger mechanism activates the fluid discharge mechanism and at least one light source served to illuminate fluid being discharged by said fluid discharge mechanism.

25. The apparatus of claim 9, and further comprising a first trigger valve coupled to the first tank, and a second trigger valve coupled to the second tank; wherein action of the first trigger valve is independent of action of the second trigger valve.

26. The apparatus of claim 7, wherein activating the sequential trigger valve is independent of activation of a second trigger valve.

27. The gun of claim 9, wherein the trigger lock mechanism selectively prevents the trigger mechanism from activating the fluid discharge mechanism and or IR transmitter.

28. The gun of claim 9, and further comprising a housing having plurality of light sources disposed therein along the fluid discharge mechanism, the housing enclosing the fluid discharge mechanism.

29. The gun of claim 10, wherein the trigger mechanism includes a mean for sequentially lighting the plurality of light sources, located along the housing of the gun and served to illuminate fluid discharged by the fluid discharge mechanism.

30. The gun of claim 9, further comprising a mechanism for discharging a generally coherent stream of fluid a means for discharging a generally conical stream of fluid wherein the mechanism for discharging a generally coherent stream of fluid is independent from the means for discharging a generally conical stream of fluid.

31. The gun of claim 13, wherein the light source is sequentially activated by sequential trigger mechanism and simultaneously with discharge of fluid by the fluid discharge mechanism.

32. The apparatus according to claim 1 wherein each of said switch plates includes a plurality of conductive strips and each conductive strip is positioned complimentary with respect to one of the strips on an opposing one of said switch plates so that when one of said switch plates sides across another of said switch plates contact between said opposing conductive strips enables a circuit to close.

33. The gun according to claim 9 wherein each of said switch plates includes a plurality of conductive strips and each conductive strip is positioned complimentary with respect to one of the strips on an opposing one of said switch plates so that when one of said switch plates sides across another of said switch plates contact between said opposing conductive strips enables a circuit to close.

34. The apparatus according to claim 16 wherein each of said switch plates includes a plurality of conductive strips and each conductive strip is positioned complimentary with respect to one of the strips on an opposing one of said switch plates so that when one of said switch plates sides across another of said switch plates contact between said opposing conductive strips enables a circuit to close.

* * * * *